US007555803B2

(12) United States Patent
Libman

(10) Patent No.: US 7,555,803 B2
(45) Date of Patent: Jul. 7, 2009

(54) SPONGE MOP CONSTRUCTION

(75) Inventor: Robert Libman, Champaign, IL (US)

(73) Assignee: The Libman Company, Arcola, IL (US)

( * ) Notice: Subject to any disclaimer, the term of this patent is extended or adjusted under 35 U.S.C. 154(b) by 0 days.

(21) Appl. No.: 11/039,014

(22) Filed: Jan. 20, 2005

(65) Prior Publication Data

US 2005/0166345 A1 Aug. 4, 2005

Related U.S. Application Data

(60) Provisional application No. 60/540,668, filed on Jan. 30, 2004.

(51) Int. Cl.
*A47L 13/144* (2006.01)

(52) U.S. Cl. ..... 15/119.2; 15/116.2; 15/262

(58) Field of Classification Search ..... 15/119.2, 15/116.2, 119.1, 116.1, 118, 262
See application file for complete search history.

(56) References Cited

U.S. PATENT DOCUMENTS

| | | | | |
|---|---|---|---|---|
| 4,196,488 | A * | 4/1980 | Barry | 15/119.2 |
| 4,706,323 | A | 11/1987 | Batchelor | |
| D302,759 | S | 8/1989 | Batchelor | |
| 4,862,550 | A | 9/1989 | Batchelor | |
| 2002/0016072 | A1 | 2/2002 | Hashii et al. | |
| 2002/0029433 | A1 | 3/2002 | Libman | |
| 2003/0115700 | A1 * | 6/2003 | Lesley et al. | 15/119.2 |

* cited by examiner

*Primary Examiner*—Shay L Karls
(74) *Attorney, Agent, or Firm*—Banner & Witcoff, Ltd.

(57) ABSTRACT

A squeeze mop head construction includes a squeeze housing with a separate and separable sponge assembly that includes catch members positioned in a manner which ensures retention of the sponge assembly by the squeeze housing, and which further ensures that lateral side-to-side movement of the sponge assembly is precluded.

8 Claims, 5 Drawing Sheets

SPONGE MOP CONSTRUCTION

CROSS-REFERENCE TO RELATED APPLICATIONS

This application is based on, and claims the benefit of, U.S. Provisional Application No. 60/540,668, filed on Jan. 30, 2004, and entitled "Sponge Mop Construction," which is incorporated herein by reference.

BACKGROUND OF THE INVENTION

Briefly the various embodiments of the present invention relate to a sponge mop construction which includes a sponge squeeze housing affixed to the end of a handle adapted to receive and cooperate with a separate and separable sponge assembly. More particularly, the embodiments relate to the construction of the separate and separable sponge assembly and its interaction with the sponge squeeze housing so as to preclude undesirable lateral slippage of movement of the sponge assembly when mounted in the squeeze housing.

The use of a mop head with a compressible sponge attached thereto is a known and popular housekeeping tool. Typically, such tools include a mechanism attaching a separable sponge assembly to a mop head and means for moving the sponge assembly or the mop head in a manner which compresses the sponge of the sponge assembly. Such compression effects the removal of excess water and cleaning agents. Various mechanisms, including levers, handles and the like, have been proposed for connecting the sponge assembly and squeeze housing and for effecting the desired squeezing action of a sponge associated with the sponge assembly.

Applicants have developed an improved combination sponge assembly and associated housing which facilitates ease of proper replacement of the sponge assembly. The construction further lends itself to maintaining the sponge assembly properly aligned with respect to the housing for the mop so as to ensure that the assembly will remain appropriately oriented and ready for use.

SUMMARY OF THE INVENTION

Briefly, the embodiments of the present invention include a squeeze mop head construction of the type which includes a sponge squeeze housing with a handle engaging element projecting from one end and flange extensions projecting from the opposite end. Rollers are mounted on the flange extensions and a separate and separable sponge assembly is provided for insertion between the rollers. The sponge assembly is constructed to enable control of lateral or side-to-side sliding movement of the sponge assembly when attached to the housing.

Thus, the embodiments of the present invention provide an improved squeeze mop construction. The mop head of the improved squeeze construction includes a sponge squeeze housing with a separate and separable sponge assembly mounted therein in a manner which assures that the sponge assembly will be maintained in a fixed position when in use and prevented from undesirable side-to-side sliding or lateral movement. The sponge mop head construction is inexpensive, yet rugged.

These and other advantages and features of the invention will be forth in the detailed description which follows.

BRIEF DESCRIPTION OF THE DRAWINGS

In the detailed description which follows reference will be made to the drawing comprised of the following Figures.

DESCRIPTION OF THE PREFERRED EMBODIMENT

Figure 1:
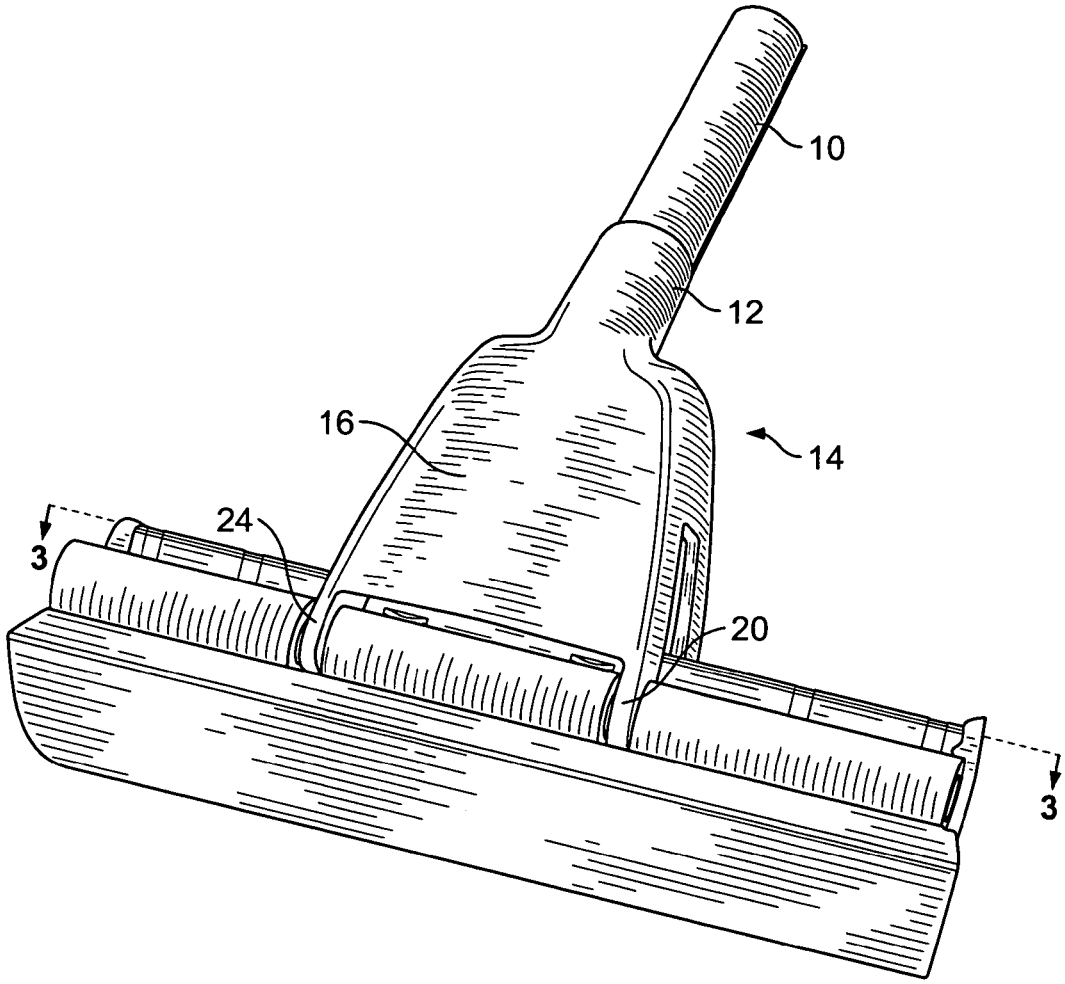
FIG. 1 is an isometric view of the squeeze mop head construction in accordance with an embodiment of the invention.

Referring to the Figures, the sponge mop and head construction includes a handle 10 which is attached to a projecting handle receptacle or receiving element 12 of a sponge squeeze housing 14. The handle 10 fits into a molded bore or passage at a first or outer end of the housing 14. The handle 10 extends longitudinally from the squeeze housing 14. Preferably the housing 14 is fabricated from a molded plastic material.

The squeeze housing 14 includes, at an opposite end 16 from the receiving element 12, four spaced, generally parallel flange extensions 20, 22, 24, 26. The extensions 20, 22, 24, 26 extend outwardly from the opposite end 16 of the housing 14. The extensions 20, 22 are spaced one from the other to define a first slot 28. The flange extensions 24, 26 are likewise spaced one from the other to define a second slot 30, which is parallel to, and substantially congruent with the first slot 28. The first slot 28 extends longitudinally toward the handle 10 from the opposite end 16 toward the receiving element 12 of the housing 14. The flange extensions 20, 24 are spaced laterally from one another as are the flange extensions 22, 26. The spacing of the extensions 20, 24 and 22, 26 is substantially equal though it is possible to provide for distinctive lateral spacing of the pairs (20, 24 and 22, 26) of flange extensions.

Each of the flange extensions 20, 22, 24, 26 include openings such as openings or passages 32 through which a rod 34 may be fitted. Thus, a rod 34 fits through openings 32 of the extensions 20, 24. A second rod 36 fits through the openings 32 associated with the extensions 22, 26.

Mounted on each of the rods 34, 36 are compression rollers such as rollers 38, 40. The compression rollers 38, 40 are of substantially uniform diameter and are arrayed on the rods 34, 36 to position the rods 34, 36 in combination with the rollers 38, 40 in a non-slidable manner mounted to the housing 14. In this manner, the rollers 38, 40 which are permanently affixed to the rods 34, 36 may act to compress a sponge member which is drawn between the sets of rollers 38, 40.

A second and separable part of the squeeze mop head construction comprises a sponge assembly 50. The sponge assembly 50 includes a compressible sponge 52 retained within a retainer housing 54 having a first retainer housing side 56 and a spaced opposite second retainer housing side 58. The sides 56, 58 are generally parallel to each other and are spaced with respect to each other approximately the same or slightly lesser distance of the spacing of the rollers 38, 40 mounted on the respective rods 34, 36. In this manner, the retainer housing 54 may be positioned or inserted between the rollers 38, 40 of the roller assembly.

Figure 2:
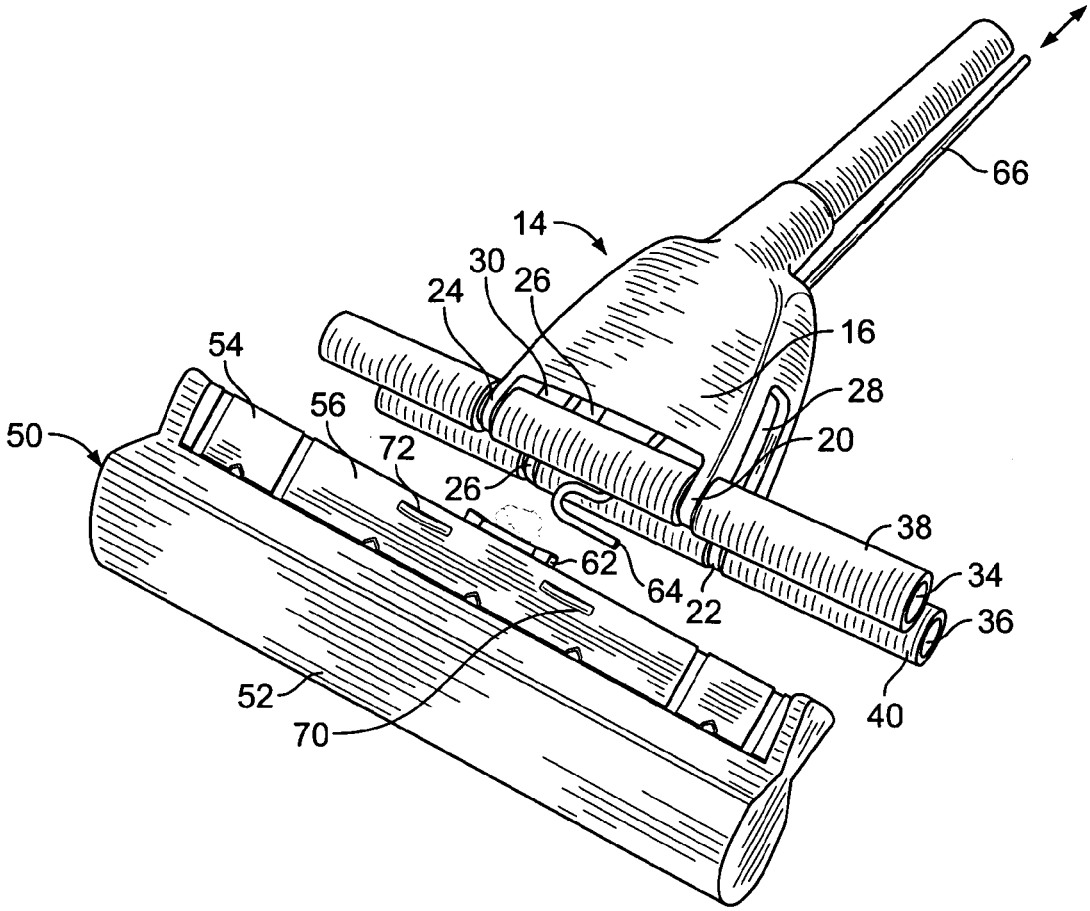
FIG. 2 is an exploded isometric view of the construction of FIG. 1.

The sponge assembly 52 further includes a connecting top side 60 of the retainer housing 54 which is typically formed from sheet metal. The top side 60 includes a formed passage or opening 62 adapted to receive the hook end 64 of a drive rod or wire 66. The hook end 64 fits into the opening 62 to grasp or grip the housing 54 and in response to movement of the drive rod 66 as indicated by the arrow in FIG. 2, for example, to thereby draw the sponge assembly 50 into the sponge squeeze housing 14. When such movement occurs then the lateral sides 56, 58 of the sponge retainer 54 will move between the sets of rollers 38, 40.

Figure 3:
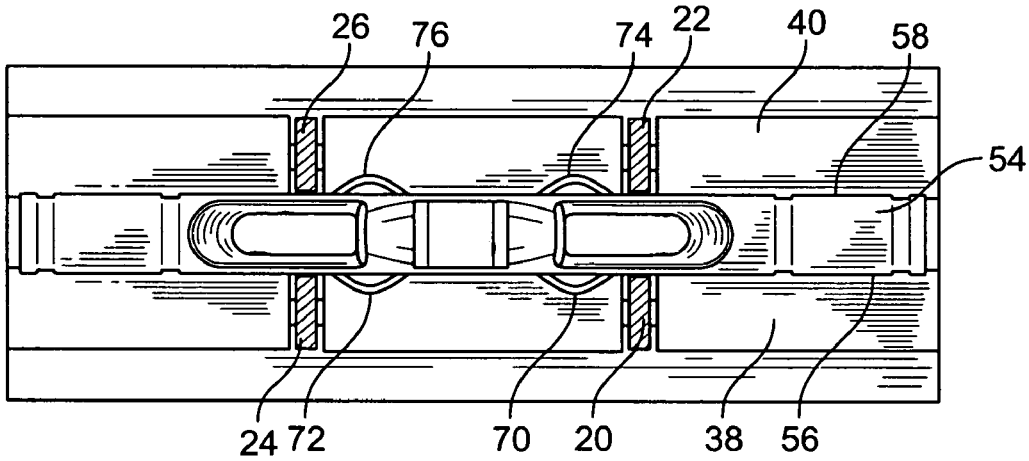
FIG. 3 is a cross sectional view of the construction of FIG. 1 taken along the line of 3-3.
Figure 4:
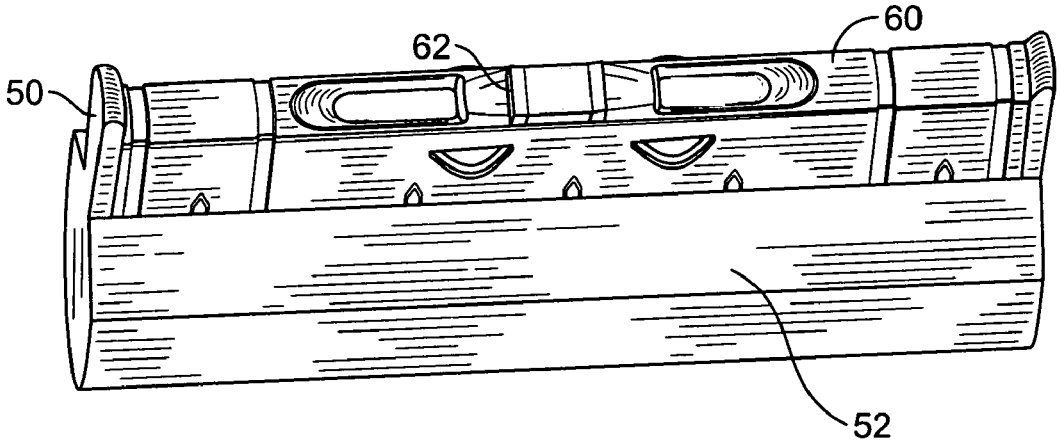
FIG. 4 is an isometric view of the separable sponge assembly associated with the sponge squeeze housing.
Figure 5:
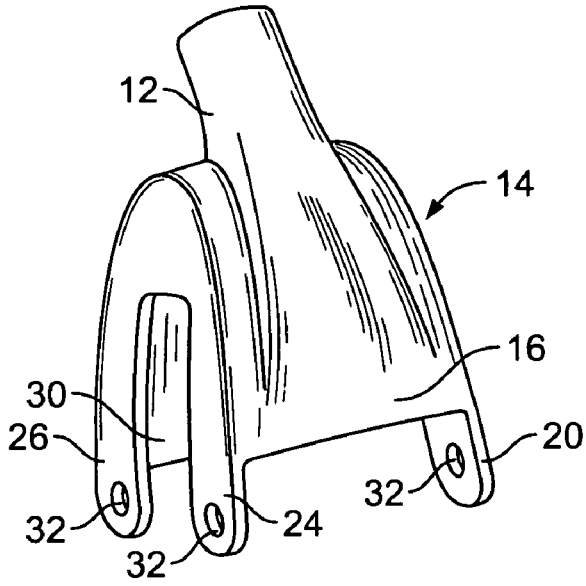
FIG. 5 is an isometric view of a part of the housing of the squeeze mop head construction.
Figure 6:
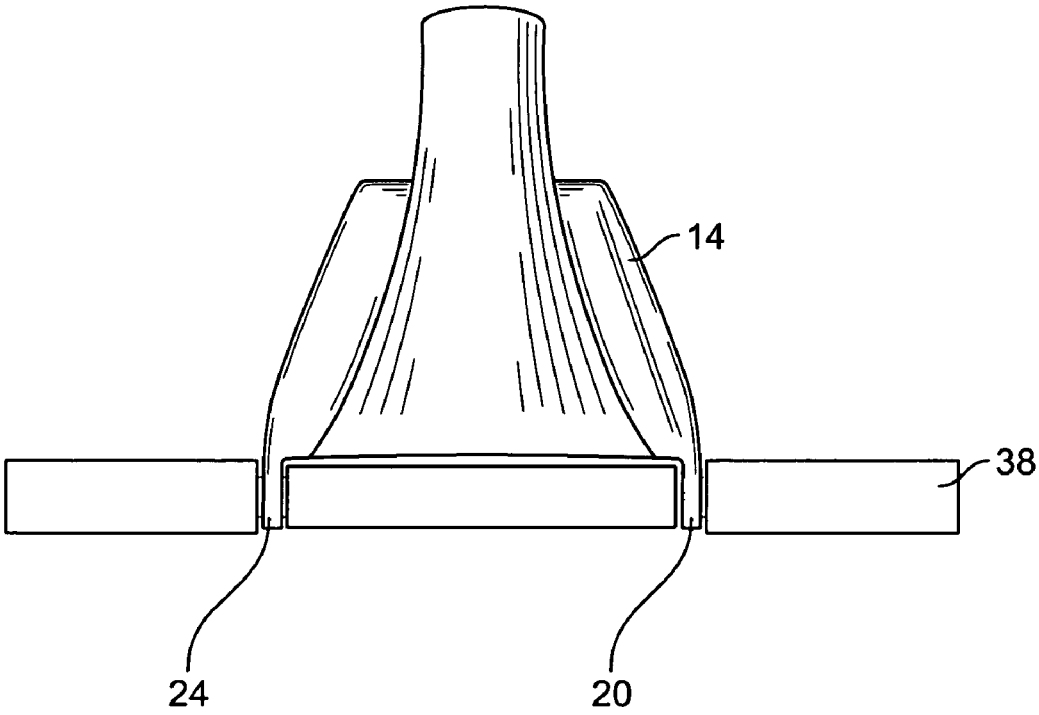
FIG. 6 is a front plan view or front elevation of the element of FIG. 5.
Figure 7:
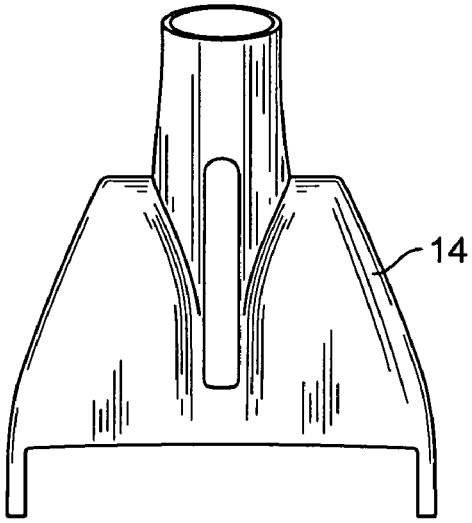
FIG. 7 is a rear plan view of the element of FIG. 5.
Figure 8:
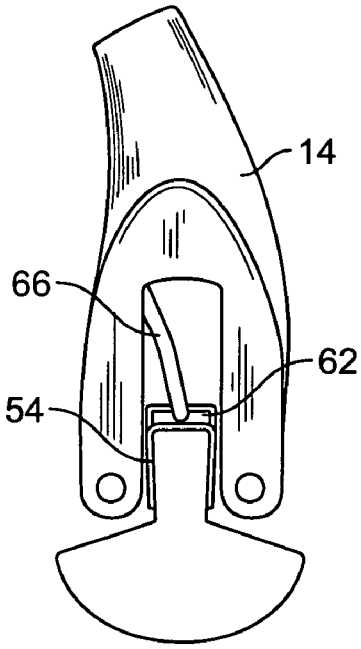
FIG. 8 is a side elevation of the element of FIG. 5.
Figure 9:
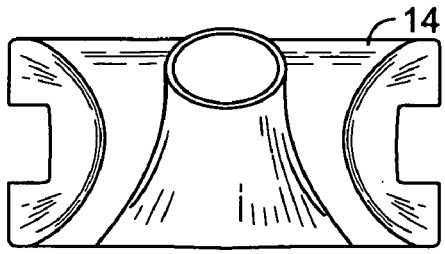
FIG. 9 is a top plan view of the element depicted in FIG. 5.

An important feature of the invention relates to the utilization of detents or catch members 70, 72, 74, 76 which are formed in the sides 56, 58 of the retainer housing 54. As depicted in FIG. 3, for example, the catches or outwardly extending detent members 70, 72, 74, 76 are positioned so that they are abutting or very close to the inside face of the flange extensions 20, 24, 22, 26, respectively. The catches or detents 70, 72, 74, 76 thus prevent undesirable lateral sliding of the sponge assembly 50 in housing 14 by engagement with flange extensions 20, 24, 22, 26, respectively. Additionally, because the projections 70, 72, 74, 76 extend outwardly from the sidewalls 56, 58, they engage against the rollers 38, 40 as the sponge assembly 52 is pulled into position via means of the hook 64. The catches or detents 70, 72, 74, 76 thus serve the dual function of retaining the sponge assembly 50 mounted to the housing 14 and, in particular, between the rollers 38, 40. The other function served is to prevent undesirable lateral side-to-side movement of sponge assembly 50. In this manner, the detents 70, 72, 74, 76 facilitate alignment of the sponge assembly 50 as well as retention thereof in a desired position, even during extremely rugged use of the squeeze mop.

Initial pulling on the drive rod 66 will cause the hook 64 to pull the sponge assembly 50 inwardly between the rollers 38, 40 into an operating position with the retainer housing 54 disposed between the rollers 38, 40. When so pulled or moved, the projections or detent mechanisms 70, 72, 74, 76 will not interfere with the operation or movement, but will maintain the appropriate orientation and movement of the sponge assembly 50 precluding undesirable lateral side-to-side movement thereof. Additional pulling on the drive rod 66 will cause the hook 64 to pull the sponge assembly 50 further inward between the rollers 38, 40 to thereby compress the sponge 52 between the rollers 38, 40.

The structure or construction of the mop head may be altered or varied without departing from the spirit and scope of the invention. For example, the flange extensions 20, 24 may be spaced differently from the extensions 22, 26, respectively, and the detents 70, 72 may then be adjusted appropriately to be compatible and generally equal with the spacing of the flange extensions. Two of the detents or projections 70, 72, 74, 76 may be omitted, for example. A single detent may be provided on each side of the sponge assembly retaining wall positioned in the manner, for example, as depicted in FIG. 3. Thus, projections (detents or catches) 70, 76 may be retained, but detents 72, 74 omitted from the construction while maintaining the functionality as described. Thus the invention has many alternative embodiments which are within the scope of the following claims and their equivalents.

What is claimed is:

1. A squeeze mop assembly, comprising:

a squeeze housing with a handle element projecting from a first end of the squeeze housing, four flange extensions projecting from the opposite end of the squeeze housing, said flange extensions configured in first and second generally parallel pairs and defining first and second spaced roller assembly mounts, each of said roller assembly mounts including a rod with squeeze rollers mounted thereon;

a separate and separable sponge assembly comprising a compressible sponge mounted in a retainer housing, said retainer housing having spaced generally parallel retainer housing sides that fit between the squeeze rollers of the first and second roller assembly mounts, the retainer housing including an opening configured to receive a hook from a drive wire to separably connect the sponge assembly to the squeeze mop assembly; and a first and second catch members on at least one of said housing retainer sides and positioned intermediate of and adjacent to said flange extensions, said first and second catch members each having a shaped configuration that extends out from the side of the retainer housing for engagement with an interior surface of the flange extension to limit lateral movement of the sponge assembly mounted in the squeeze housing and for engagement with the squeeze rollers so as to aid in retaining the sponge assembly between the rollers, wherein, in operation, the first and second catch members extend from the retainer housing sufficiently to prevent the first and second catch members from moving laterally past the flange extensions.

2. The assembly of claim 1, wherein a third and fourth catch member are on an opposite side the retainer housing and aligned with the first and second catch members, whereby the first and third catch members and the second and fourth catch members cooperate to prevent lateral movement of the catch members past said flange extensions.

3. The assembly of claim 1, wherein the first and second catch members are provide a gradually curved surface for engaging said flange extensions.

4. The assembly of claim 1, wherein the first and second catch members are formed by a partial loop-shaped band extending from the side of the retainer housing.

5. A squeeze mop assembly, comprising:

a squeeze housing with a handle element projecting from a first end of the squeeze housing, four flange extensions projecting from the opposite end of the squeeze housing, said flange extensions configured in first and second generally parallel pairs and defining first and second spaced roller assembly mounts, each of said roller assembly mounts including a rod with squeeze rollers mounted thereon;

a separate and separable sponge assembly comprising a compressible sponge mounted in a retainer housing, said retainer housing having spaced generally parallel retainer housing sides that fit between the squeeze rollers of the first and second roller assembly mounts, the retainer housing including an opening configured to receive a hook from a drive wire to separably connect the sponge assembly to the squeeze mop assembly; and a first and second catch members on at least one of said housing retainer sides and positioned intermediate of and adjacent to said flange extensions, said first and second catch members each having a shaped configuration that extends out from the side of the retainer housing for engagement with an interior surface of the flange extension to limit lateral movement of the sponge assembly mounted in the squeeze housing and for engagement with the squeeze rollers so as to aid in retaining the sponge assembly between the rollers, wherein, in operation, the first and second catch members extend from the retainer housing sufficiently to prevent the first and second catch members from moving laterally past the flange extensions, wherein the first and second catch members are positioned abutting to the interior surface of the respective flange extensions.

6. The assembly of claim 5, wherein a third and fourth catch member are on an opposite side the retainer housing and aligned with the first and second catch members, whereby the first and third catch members and the second and fourth catch members cooperate to prevent lateral movement of the catch members past said flange extensions.

7. The assembly of claim 5, wherein the first and second catch members are provide a gradually curved surface for engaging said flange extensions.

8. The assembly of claim 5, wherein the first and second catch members are formed by a partial loop-shaped band extending from the side of the retainer housing.

* * * * *